US005765464A

United States Patent [19]

Morita

[11] Patent Number: 5,765,464

[45] Date of Patent: Jun. 16, 1998

[54] RECIPROCATING PISTONS OF PISTON-TYPE COMPRESSOR

[75] Inventor: Yujirou Morita, Honjou, Japan

[73] Assignee: Sanden Corporation, Gunma, Japan

[21] Appl. No.: 816,691

[22] Filed: Mar. 13, 1997

[30] Foreign Application Priority Data

Mar. 19, 1996 [JP] Japan ..... 8-062402

[51] Int. Cl.[6] ..... F01B 3/00

[52] U.S. Cl. ..... 92/71; 92/172; 417/269

[58] Field of Search ..... 92/12.2, 71, 172, 92/176, 208, 213; 91/499, 500, 504, 505; 417/269

[56] References Cited

U.S. PATENT DOCUMENTS

| | | | |
|---|---|---|---|
| 1,714,145 | 5/1929 | Sperry | 92/71 |
| 3,369,458 | 2/1968 | Slimm | 92/208 |
| 3,800,675 | 4/1974 | Jacobs . | |
| 3,885,460 | 5/1975 | Park . | |
| 3,982,471 | 9/1976 | Finger . | |
| 4,065,229 | 12/1977 | Black . | |
| 4,073,603 | 2/1978 | Abendschein et al. . | |
| 4,145,163 | 3/1979 | Fogelberg et al. . | |
| 4,174,191 | 11/1979 | Roberts . | |
| 4,351,227 | 9/1982 | Copp, Jr. et al. . | |
| 4,379,425 | 4/1983 | Ishizuka . | |
| 4,416,589 | 11/1983 | Perry . | |
| 4,425,837 | 1/1984 | Livesay . | |
| 4,480,964 | 11/1984 | Skinner . | |
| 4,526,516 | 7/1985 | Swain et al. . | |
| 4,594,055 | 6/1986 | Hatakeyama et al. . | |
| 4,664,604 | 5/1987 | Terauchi . | |
| 5,380,167 | 1/1995 | Burkett et al. | 417/269 |
| 5,630,353 | 5/1997 | Mittlefehldt et al. | 92/71 |

FOREIGN PATENT DOCUMENTS

| | | |
|---|---|---|
| 3602651 | 7/1987 | Germany . |
| 4207186 | 9/1992 | Germany . |
| 4109481 | 9/1992 | Japan . |
| 7189898 | 7/1995 | Japan . |
| 7189900 | 7/1995 | Japan . |
| 895667 | 5/1962 | United Kingdom . |

OTHER PUBLICATIONS

European Search Report Dated Jul. 1, 1997.

*Primary Examiner*—Thomas E. Denion
*Attorney, Agent, or Firm*—Baker & Botts, L.L.P.

[57] ABSTRACT

A piston-type compressor has at least two cylinders formed in a cylinder block which is formed in a compressor housing. A piston is slidably disposed within each of the cylinders. Each of the pistons includes a cylindrical main body and an engaging portion axially extending from the cylindrical body. A drive shaft is rotatably supported in the cylinder block. A bearing couples the plate to each of the pistons, so that the pistons reciprocate within the cylinder bores upon rotation of the plate which is tiltably connected to the drive shaft. The piston includes a first aperture formed in a periphery surface of cylindrical body thereof; a second aperture formed in an interior the cylindrical body thereof, so that the second aperture communicates with the first aperture; and a cover plate member secured to the one axial end thereof for covering the second aperture. Therefore, the configuration obtains lightweight pistons while simultaneously preventing reducing the efficiency of the compressor.

23 Claims, 7 Drawing Sheets

RECIPROCATING PISTONS OF PISTON-TYPE COMPRESSOR

BACKGROUND OF THE INVENTION

1. Field of the Invention

The invention relates to a piston-type compressor, in which fluid is compressed by means of reciprocating pistons connected to a swash plate. More particularly, it relates to a configuration of reciprocating pistons, which reduces the weight of the pistons in the refrigerant compressor for an automotive air conditioning system.

2. Description of the Related Art

A variable capacity, swash plate-type compressor is disclosed in U.S. Pat. No. 4,664,604, which is incorporated herein by reference.

Referring to FIG. 1, a cylinder block 13 is accommodated in cylindrical housing 11 of a compressor 10. Pistons 28 are accommodated in cylinder bores 27 and are reciprocally movable therein. A drive shaft 15, which is driven by an engine, is rotatably supported by means of the central portion of cylinder block 13 and a front cover 12. Rotor plate 18 is mounted on drive shaft 15, and synchronously rotates with draft shaft 15. Further, a swash plate 24 is tiltably mounted on drive shaft 15 and is reciprocally slidable together with special sleeve 30 parallel to the axis of drive shaft 15. Rotor plate 18 and swash plate 24 are connected to each other by means of a hinge mechanism. Swash plate 24 engages the interior portion of the associate piston(s) 28 along its circumference.

According to the above-described compressor, when drive shaft 15 is rotated, rotor plate 18 rotates together with drive shaft 15. The rotation of rotor plate 18 is transferred to swash plate 24 through the hinge mechanism. Rotor plate 18 is rotated with a surface inclined with respect to drive shaft 15, so that pistons 28 reciprocate in the cylinder bore 27, respectively. Therefore, refrigerant gas is drawn into an inlet chamber and compressed and discharged from the inlet chamber into an associated discharge chamber.

Control of displacement of this compressor is achieved by varying the stroke of piston 28. The stoke of piston 28 varies depending on the difference between pressures which are acting on the opposing sides of swash plate 24. The difference is generated by balancing the pressure in a crank chamber acting on the rear surface of piston 28 with the suction pressure in cylinder bore 27 acting on the front surface of piston 28, which suction pressure acts on swash plate 24 through piston 28.

In the above mentioned variable capacity, swash plate-type compressor, it is desirable to reduce the load that is applied to the compressor's drive source, e.g., a vehicle engine. To accomplish this, piston 28 is preferably lightweight.

Accordingly, a main body of each piston 28 which reciprocates in cylinder bore 27 is formed with an open space **28*a* therein. A protrusion 29 thereof axially extends from the main body to engage a radial aperture at the periphery of swash plate 24 via sleeve 30**.

A second approach to reducing the weight of the pistons is disclosed in unexamined Japanese Utility Patent Publication No. H4-109481, published on Sep. 22, 1992. Referring to FIG. 2, a piston 38 which includes cylindrical body **38*a* and closed hollow portion 38*b* therein is produced, such that at least two separated cylindrical hollow elements are joined together by welding. An arm portion 38*c* extends from cylindrical body 38*a***.

A third approach to reducing the weight of the pistons is disclosed in unexamined Japanese Utility Patent Publications Nos. H7-189898 and H7-189900, both published on Jul. 28, 1995. Referring to FIGS. **3*a* and 3*b*, a piston 48 has a solid, cylindrical body 48*a*. A first aperture 48*b* and a second aperture 48*c* are formed on the periphery of cylindrical body 48*a*, such that these apertures communicate with each other. Referring to FIG. 4, a piston 58 has a cylindrical body 58*a* and a recessed portion 58*b* formed on a half radial, side surface of cylindrical body 58*a*. Recessed portion 58*b* is scooped out toward the interior of cylindrical body 58*a* of piston 58**.

Nevertheless, the pistons discussed above have at least the following disadvantages. In the piston of FIG. 1 described in U.S. Pat. No. 4,664,604, hollow portion **28*a* of piston 28 can not maintain a great capacity therein because a bite of machining metals can not be inserted deep into the interior of piston 28 from one axial end of piston 28 toward the longitudinal axis of piston 58. In the piston of FIG. 2 described in unexamined Japanese Utility Patent Publication No. H4-0109481, when the piston is produced by a forging machine, closed hollow portion 38*b* of piston 38 is formed by scooping out material from one end portion near the piston head toward an arm portion 38*c* of piston 38. If a welded jointed portion is to be placed near the piston head, cylindrical hollow portion 38*b* near arm portion 38*c* has a smaller radial inner diameter than the piston head. Moreover, inner diameter of cylindrical hollow portion 38*b* gradually decreases toward arm portion 38*c* because a core inserted into cylindrical hollow portion 38*b* for forging is drawn cut from molding die. Thus, an area having a small diameter is added during the cutting process in order to maintain a uniform diameter and to prevent the above-mentioned disadvantages. Accordingly, this configuration results in increasing the overall weight of piston 38 or in increasing the production cost of piston 38**, or both.

On the other hand, if a welded jointed portion is placed near arm portion **38*c*, the frictional force which is generated by the sliding of swash plate 24 within sleeve 30 is transferred to piston 38 and urges piston 38 to rotate around its axis and to incline in a radial direction. In particular, because the moment perpendicular to drive shaft 15 and to the longitudinal axis of piston 38 acts on the welded joint portion of cylindrical body 38*a***, the welded joint portion is easily broken.

In the pistons of FIGS. **3*a* and 3*b* described in unexamined Japanese Patent Publications No. H7-189898 and of FIG. 4 described in unexamined Japanese Utility Patent Publication No. H7-189900, the radial periphery surface of cylindrical body 48*a* of piston 48, which make contact with the inner surface of cylinder bore 27, decreases since apertures 48*b* and 48*c* of a recessed portion cover the greater parts of the radial periphery surface of cylindrical body 48*a* or 58*a* of piston 48 or of piston 58, respectively. Therefore, gas compressed within cylinder bore 27 leaks out to the crank chamber because the sealing area decreases between the radial periphery surface of piston 48 or of piston 58, and the inner surface of cylinder bore 27**. As a result, the compression efficiency of the compressor is reduced.

SUMMARY OF THE INVENTION

It is an object of the invention to provide a piston-type compressor which has lightweight pistons while simultaneously preventing a reduction of the compression efficiency thereof It is another object of the present invention to provide a piston-type compressor that has a piston of superior durability.

It is still another object of the present invention to provide a piston-type compressor which is simple to manufacture.

According to the present invention, a piston-type fluid displacement apparatus comprises a housing enclosing a crank chamber, a suction chamber, and a discharge chamber. The housing includes a cylinder block, and a plurality of cylinder bores are formed in the cylinder block. A drive shaft is rotatably supported in the cylinder block. A plurality of pistons are slidably disposed within the cylinders. Each of the pistons includes a cylindrical body and an engaging portion axially extending from a first axial end of the cylindrical body. A plate having an angle of tilt is tiltably connected to the drive shaft. A bearing couples the plate to each of the pistons so that the pistons reciprocate within the cylinder bores upon rotation of the plate. At least one working chamber is defined between an end of each of the pistons and an inner surface of each of the cylinders. A support portion is disposed coaxially with the drive shaft and tiltably supports a central portion of the plate. The piston includes a first aperture formed in a periphery surface of the cylindrical body thereof, a second aperture formed in an interior the cylindrical body thereof so as to communicate with the first aperture, and a cover plate member secured to a second axial end of the cylindrical body for covering the second aperture.

In another embodiment, a swash plate type compressor comprises a housing enclosing a crank chamber, a suction chamber, and a discharge chamber. The housing includes a cylinder block, and a plurality of cylinder bores are formed in the cylinder block. A plurality of pistons are slidably disposed within the cylinders. Each of the pistons includes a cylindrical body and an engaging portion axially extending from a first axial end of the cylindrical body. A drive shaft is ratably supported in the cylinder block. A plate having an angle of tilt is tiltably connected to the drive shaft. A bearing couples the plate to each of the pistons so that the pistons reciprocate within the cylinder bores upon rotation of the plate. At least one working chamber is defined between an end of each of the pistons and an inner surface of each of the cylinders. A support portion is disposed coaxially with the drive shaft and tiltably supports a central portion of the plate. The piston includes a first aperture formed in a periphery surface of the cylindrical body thereof, a second aperture formed in an interior the cylindrical body thereof so as to communicate with the first aperture, and a cover plate member secured to a second axial end of the cylindrical body for covering the second aperture.

DETAILED DESCRIPTION OF THE DRAWINGS

Figure 5:
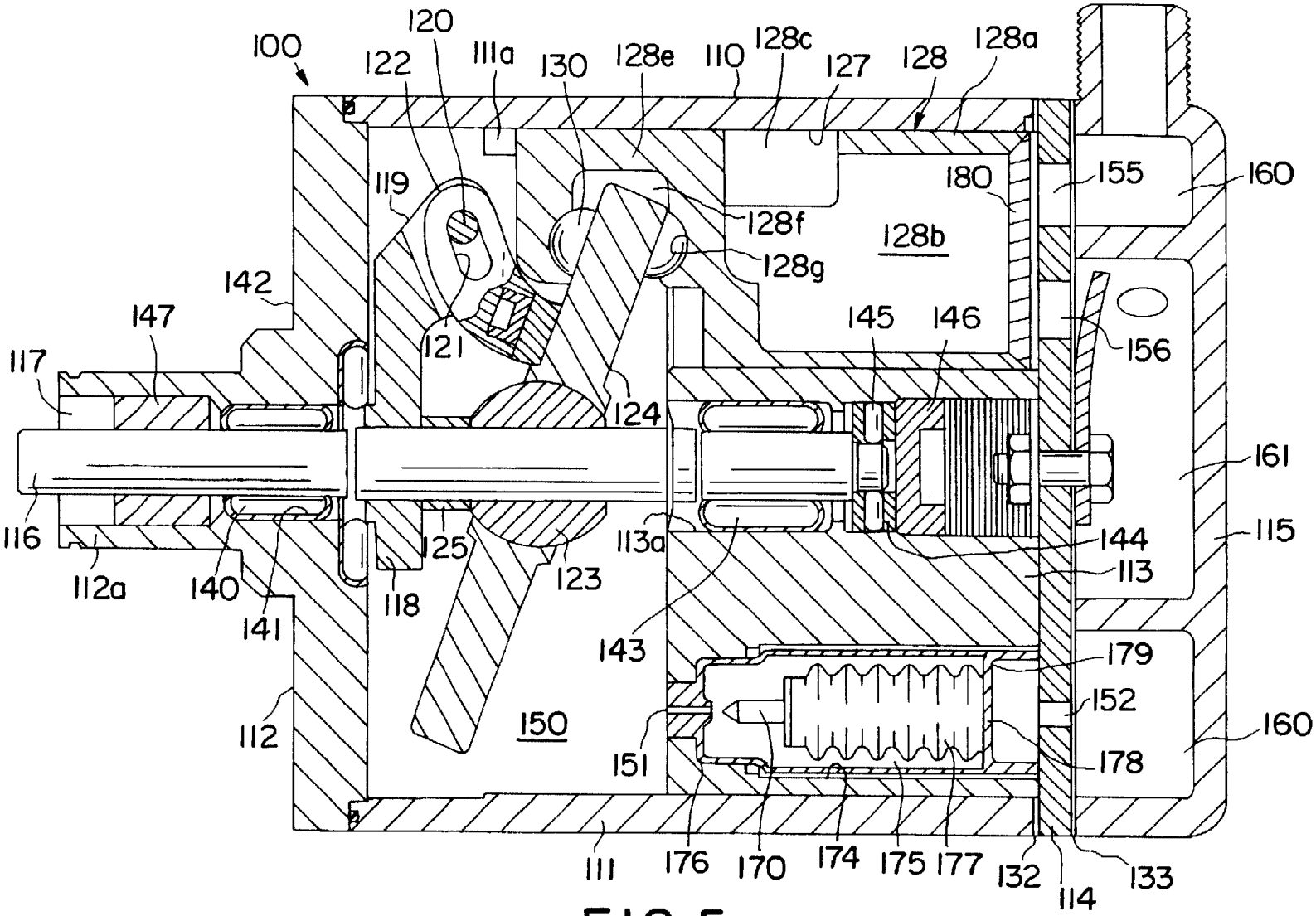
FIG. 5 is a longitudinal cross-sectional view of a swash plate refrigerant compressor with a variable displacement mechanism in accordance with a first embodiment of the present invention.

Referring to FIG. 5, a refrigerant compressor according to this invention is shown. The compressor, which is generally designated by reference number 100, includes closed cylinder housing assembly 110 formed by annular casing 111 provided with cylinder block 113 at one of its sides; a hollow portion, such as crank chamber 150; front end plate 112; and rear end plate 115.

Front end plate 112 is mounted on the left end opening of annular casing 111 to close the end opening of crank chamber 150 and is fixed on casing 111 by a plurality of bolts (not shown). Rear end plate 115 and a valve plate 114 are mounted on the other end of casing 111 by a plurality of bolts (not shown) to cover the end portion of cylinder block 113. An opening 141 is formed in front end plate 112 for receiving drive shaft 116. An annular sleeve 112*a* projects from the front end surface of front end plate 112 and surrounds drive shaft 116 to define a shaft seal cavity 117. A shaft seal assembly 147 is assembled on drive shaft 116 within shaft seal cavity 117.

Drive shaft 116 is rotatably supported by front end plate 112 through bearing 140, which is disposed of within opening 141. The inner end of drive shaft 116 is provided with a rotor plate 118. Thrust needle bearing 142 is placed between the inner end surface of front end plate 112 and the adjacent axial end surface of rotor plate 118 to receive the thrust load that acts against rotor plate 118 and to ensure smooth motion. The outer end of drive shaft 116, which extends outwardly from sleeve 112*a*, is driven by the engine of a vehicle through a conventional pulley arrangement (not shown). The inner end of drive shaft 116 extends into central bore 113*a*, which is formed in the center portion of cylinder block 113 and is rotatably supported therein by a bearing, such as radial bearing needle bearing 143. The axial position of drive shaft 116 may be adjusted by adjusting screw 146 which screws into a threaded portion of center bore 113*a*. A spring device 144 is disposed between the axial end surface of drive shaft 116 and adjusting screw 146. A thrust needle bearing 145 is placed between drive shaft 116 and spring device 144 to ensure smooth rotation of drive shaft 116.

A spherical bushing 123 placed between rotor plate 118 and the inner end of cylinder block 113 is slidably carried on drive shaft 116. Spherical bushing 123 supports a slant or swash plate 124 for both nutational, e.g., wobbling, and rotational motion. A coil spring 125 surrounds drive shaft 116 and is placed between the end surface of rotor plate 118 and one axial end surface of spherical bushing 123 to push spherical bushing 123 toward cylinder block 113.

Swash plate 124 is connected to rotor plate 118 by a hinge coupling mechanism for rotating in unison with rotor plate 118. In particular, rotor plate 118 may have an arm portion 119 projecting outward axially from one side surface thereof Swash plate 124 also may have arm portion 122 projecting toward arm portion 119 of rotor plate 118 from one side surface thereof. In this embodiment, arm portion 122 is formed separately from swash plate 124 and is fixed on one side surface of swash plate 124.

Arm portions 119 and 122 overlap each other and are connected to one another by a pin 120 which extends into rectangular shaped hole 121 formed through arm portion 122 of swash plate 124. In this manner, rotor plate 118 and swash plate 124 are hinged to one another. In this construction, pin 120 is slidably disposed in rectangular hole 121, and the sliding motion of pin 120 within rectangular hole 121 changes the slant angle of the inclined surface of swash plate 124.

Cylinder block 113 has a plurality of annularly arranged cylinders 127 into which pistons 128 slide. A cylinder arrangement may include five cylinders, but a smaller or larger number of cylinders also may be provided. Each piston 128 comprises a cylindrical body **128*a* slidably disposed within cylinder 127 and a connecting portion 128*e*. Connecting portion 128*e* of piston 128 has a cutout portion 128*f* which straddles the outer periphery portion of swash plate 124. Semi-spherical thrust bearing shoes 130 are disposed between each side surface of swash plate 124 and face semi-spherical pocket 128*g* of connecting portion 128*e*. Thus, swash plate 124 rotates between bearing shoes 130, moving the inclined surface axially to the right and left, thereby reciprocating pistons 128 within cylinders 127. Cylinder housing 111 may also include projection portion 11*a* extending therefrom to the inside thereof and parallel to the reciprocating direction of piston 128**.

Rear end plate 116 is shaped to define a suction chamber 160 and discharge chamber 161. Valve plate member 114, which together with rear end plate 115 is fastened to the end of cylinder block 113 by screws, is provided with a plurality of valved suction ports 155 connected between suction chamber 160 and respective cylinders 127, and with a plurality of valved discharge ports 156 connected between discharge chamber 161 and respective cylinders 127. Suitable reed valves for suction ports 155 and discharge ports 156 are described in U.S. Pat. No. 4,011,029. Gaskets 132 and 133 are placed between cylinder block 113 and valve plate 114, between cylinder block 113 and valve plate 114, and between valve plate 1 14 and rear end plate 1 15 to seal the matching surfaces of the cylinder block, the valve plate, and the rear end plate.

As shown in the bottom right-hand portion of FIG. 5, crank chamber 150 and suction chamber 160 are connected by a passageway 175 which comprises an aperture 152 formed through valve plate 114 and gaskets 132, 133 and bore 174 formed in cylinder block 113. A coupling element 176 with a small aperture 151 is disposed in the end opening of bore 174 which faces crank chamber 150. Bellows element 177 contains gas and includes needle valve 170 disposed in bore 174. The opening and closing of small aperture 151, which connects between crank chamber 150 and bore 175, is controlled by needle valve 170. The axial position of bellows element 177 is determined by frame element 178 disposed in bore 174. At least one hole 179 is formed through frame 178 to permit communication between aperture 152 and bore 174.

In operation, drive shaft 116 is rotated by the engine of a vehicle through the pulley arrangement, and rotor plate 1 18 is rotated together with drive shaft 116. The rotation of rotor plate 118 is transferred to swash plate 124 through the hinge coupling mechanism so that, with respect to the rotation of rotor plate 118, the inclined surface of swash plate 124 moves axially to the right and left. Consequently, pistons 128, which are operatively connected to swash plate 124 by means of swash plate 124 sliding between bearing shoes 130, reciprocate within cylinders 127. As pistons 128 reciprocate, the refrigerant gas which is introduced into suction chamber 160 from the fluid inlet port, is taken into each cylinder 127 and compressed. The compressed refrigerant gas is discharged into discharge chamber 161 from each cylinder 127 through discharge port 156 and therefrom into an external fluid circuit, for example, a cooling circuit, through the fluid outlet port.

Control of displacement of the compressor may be achieved by varying the stroke of piston 128. The stroke of piston 128 varies depending on the difference between pressures which are acting on the both sides of swash plate 124, respectively. The difference is generated by balancing the pressures in the crank chamber acting on the rear surface of piston 128 with the suction pressure in cylinder bore 127 which acts on the front surface of piston 128, and further on swash plate 124 through piston 128.

When the heat load of the refrigerant gas exceeds a predetermined level, the suction pressure is increased. The pressure of the gas contained in bellows element 177 may be set to be almost the same as the pressure in a predetermined heat load level; thus, bellows element 177 is pushed toward the right side to open aperture 151. Therefore, the pressure in crank chamber 150 is maintained at the suction pressure. In this condition, during the compression stroke of pistons 128, the reaction force of gas compression acts against swash plate 124 and is received by the hinge coupling mechanism.

Alternatively, if the heat load is decreased and the refrigerant capacity is exceeded, the pressure in suction chamber 160 decreases and bellows element 177 is moved to the left side to close small aperture 151 with needle valve 170. In this case, the pressure in the crank chamber 150 is gradually raised and a narrow pressure difference occurs because blow-by gas, which leaks from the working chamber to crank chamber 150 through a gap between piston 128 and cylinder bore 127 during the compression stroke, is contained in crank chamber 150.

Referring to FIGS. **6*a*, 6*b*, and 6*c*, piston 128 includes a cylindrical body 128*a*, connecting portion 128*e* extending from first end of cylindrical body 128*a*, a cylindrical hollow portion 128*b* formed in cylindrical body 128*a*, at least one aperture 128*c* formed on the radial periphery surface of cylindrical body 128*a* and a circular plate member 180 fixed to the second end of cylindrical body 128*a*. Connecting portion 128*e* of piston 128 have a cutout portion 128*f* which straddles the outer periphery portion of swash plate 124. A pair of semi-spherical pockets 128*g* are formed on connecting portion 128*e* and on one axial end of cylindrical body 128*a* for engaging semi-spherical thrust bearing shoes 130. At least one aperture 128*c*, which forms a rectangular-shape along the periphery surface curve of cylindrical body 128*a* such that longer sides of rectangular aperture 128*c* are perpendicular to the longitudinal axis of piston 128, communicates with a cylindrical hollow portion 128b. Circular plate member 180, having a smaller diameter than that of cylindrical body 128a, is inserted into and secured to an annular recessed portion 128d of cylindrical body 128a by welding, by forcible insertion, or by screws. Piston 128 may be made of metal, preferably aluminum. Circular plate member 180 may be made of metal or an engineering plastic. In a preferred embodiment circular plate member 180** is made of aluminum.

Figure 6A:
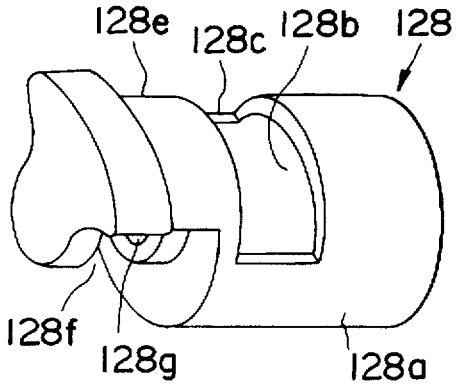
FIG. 6*a* is a first perspective view of a piston in accordance with a second embodiment of the present invention.
Figure 6B:
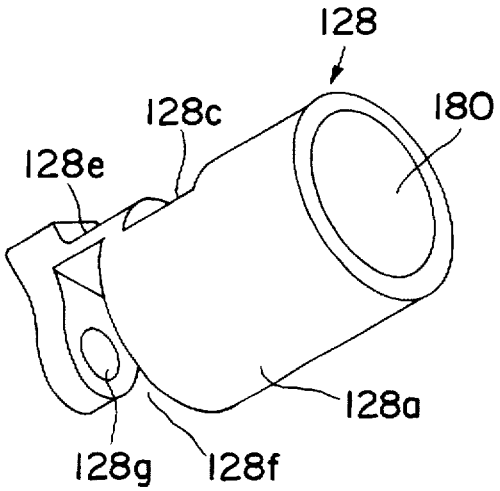
FIG. 6*b* is a second perspective view of a piston in accordance with a second embodiment of the present invention.
Figure 6C:
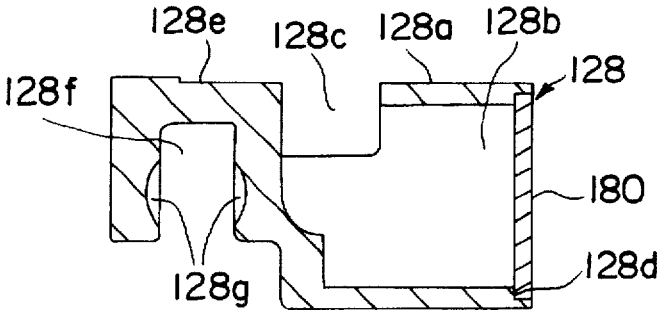
FIG. 6*c* is a cross-sectional view of the piston in accordance with the second embodiment of the present invention.
Figure 6D:
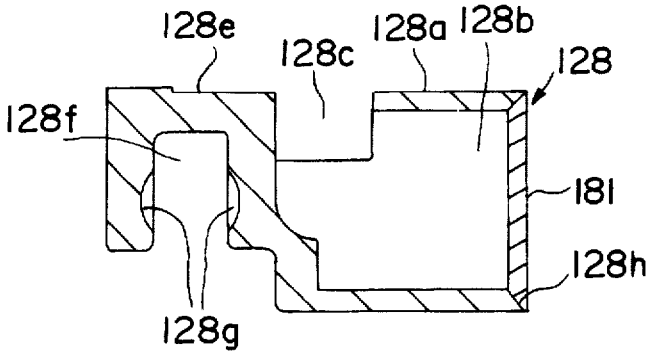
FIG. 6*d* is a cross-sectional view of the piston having another circular plate in accordance with the second embodiment of the present invention.

Referring to FIG. 6d, in another embodiment circular plate member 181, which is a truncated cone cylinder-shape, is secured by cylindrical body 128a such that the circular edge of circular plate member 181 may be welded to a tapered portion 128h of cylindrical body 128a.

Figure 1:
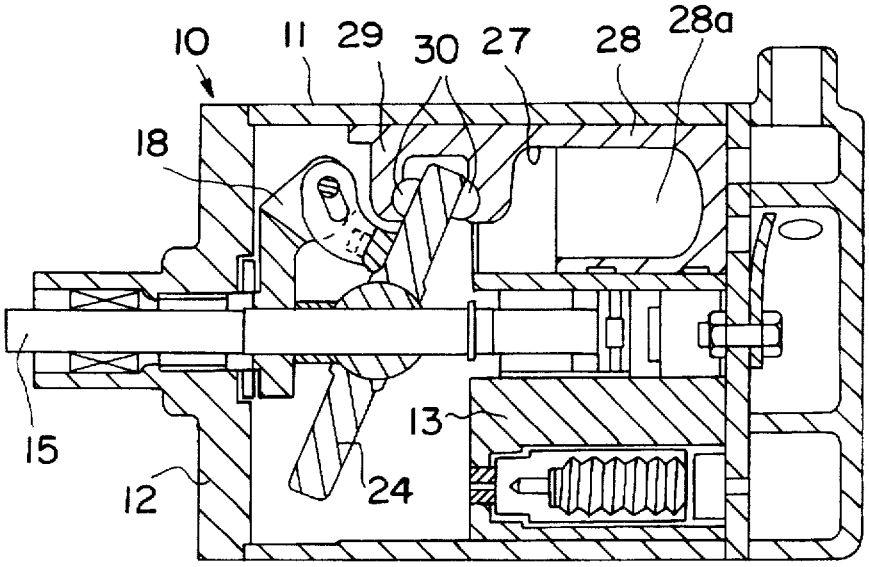
FIG. 1 PRIOR ART
FIG. 1 is a longitudinal cross-sectional view of a swash plate refrigerant compressor with a variable displacement mechanism in accordance with a first prior art embodiment.

Therefore, cylindrical hollow portion 128b may be created in cylindrical body 128a of piston 128 in contrast to FIG. 1 of the prior art because piston 128 forms not only cylindrical aperture 128c but also cylindrical hollow portion 128b therein. Namely, the construction prevents the thickness of cylindrical hollow portion 128b from becoming largely drawn out from molding because length of a core, which is inserted into cylindrical hollow portion 128b for forging and drawing out from molding, is shorter than that of the prior art.

Figure 3A:
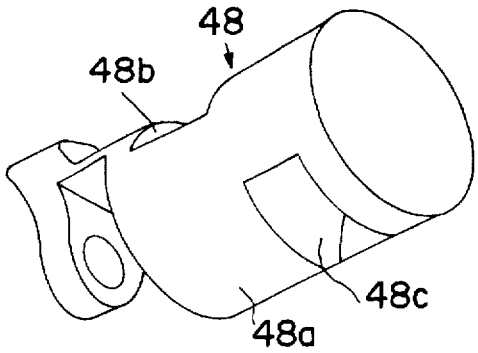
FIG. 3A PRIOR ART
FIG. 3*a* is a perspective view of a piston in accordance with a third prior art embodiment.
Figure 3B:
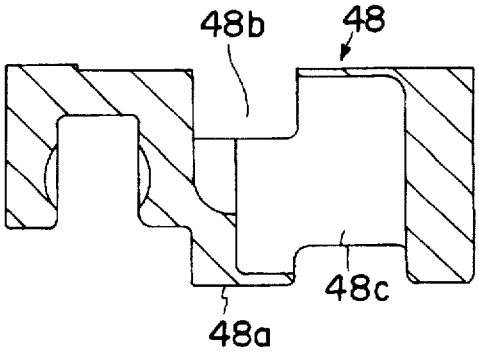
FIG. 3B PRIOR ART
FIG. 3*b* is a longitudinal cross-sectional view of the piston in accordance with the third prior art embodiment.
Figure 4:
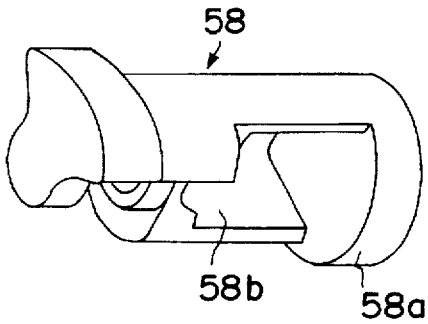
FIG. 4 PRIOR ART
FIG. 4 is a perspective view of a piston in accordance with a forth prior art embodiment.

Further, sealing the area between a radial periphery surface of cylindrical body 128a of piston 128 substantially increases the inner surface of cylinder bore 127 in contrast to those of FIGS. 3a, 3b and 4.

Figure 2:
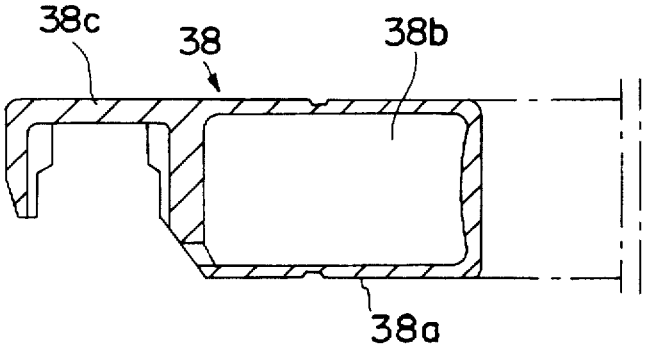
FIG. 2 PRIOR ART
FIG. 2 is a longitudinal cross-sectional view of a piston in accordance with a second prior art embodiment.

As a result, piston 128 is lightweight or may result in reduced production costs, or both, while simultaneously maintaining the compression efficiency of a compressor. Further, although the radial direction moment, which is generated by sliding of swash plate 124 within sleeve 130 and perpendicular to drive shaft 116 and the longitudinal axis of piston 128, acts to the welded joint portion between circular plate member 180 or 181 and cylindrical body 128a of piston 128, the welded joint portion is not broken because the moment is balanced to control the stress caused by the circular edge of circular plate member 180 or 181 as opposed to that described in FIG. 2 of the prior art.

Figure 7:
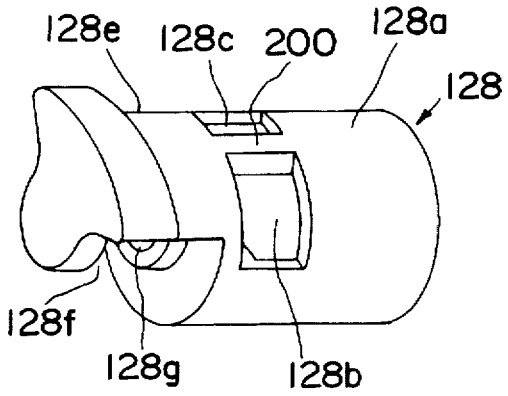
FIG. 7 is a perspective view of a piston in accordance with a third embodiment of the present invention.

FIG. 7 illustrates a second embodiment of the present invention which is similar to a first embodiment except for the following construction. Piston 128 includes at least one supporting portion 200 formed at the center of aperture 128c. Supporting portion 200 joins one long side to other long side of aperture 128c.

Figure 8A:
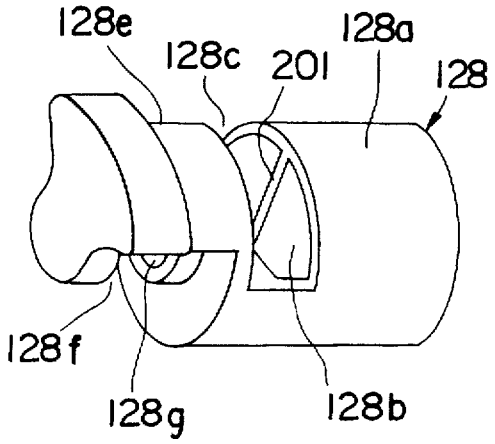
FIG. 8*a* is a perspective view of a piston in accordance with a fourth embodiment of the present invention.
Figure 8B:
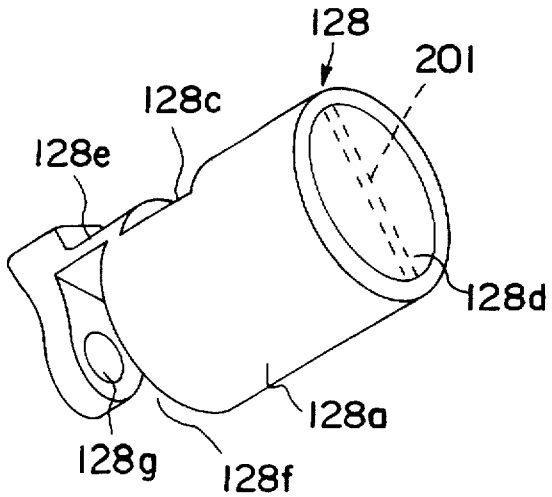
FIG. 8*b* is another perspective view of a piston in accordance with a fourth embodiment of the present invention.

FIGS. 8a and 8b illustrate a third embodiment of the present invention and similar to a first embodiment except for the following constructions. Piston 128 includes at least one guiding portion 201 formed in cylindrical hollow portion 128b. Guiding portion 201 extends from one inner surface to other inner surface of cylindrical body 128a through the center of cylindrical hollow portion 128b. Guiding portion 201 also extends from one axial end of cylindrical hollow portion 128b to the side of aperture 128c. In such structures, substantially the same advantages as those in the first embodiment may be achieved. Further, the construction may reinforce a weakness of cylindrical body 128a of piston 128 due to forming both cylindrical hollow portion 128b and aperture 128c.

Figure 9:
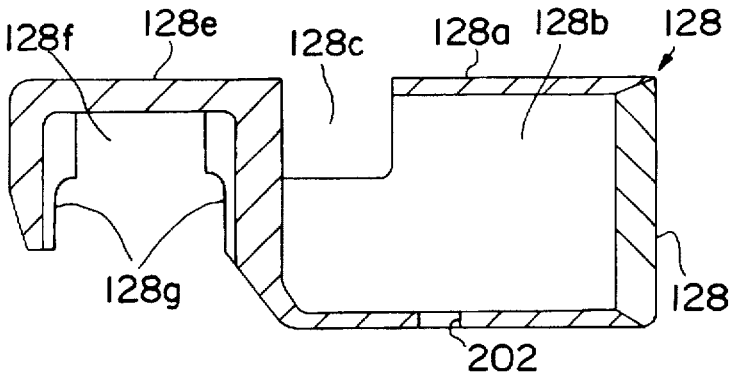
FIG. 9 is a cross-sectional view of a piston in accordance with a fifth embodiment of the present invention.

FIG. 9 illustrates a fourth embodiment of the present invention that is similar to a first embodiment except for the following constructions. Piston 128 includes at least one small opening 202 formed on the outer periphery surface of cylindrical body 128. At least one small opening 202 penetrates the outer periphery surface of cylindrical body 128a to cylindrical hollow portion 128b for introducing lubricating oil.

Figure 10:
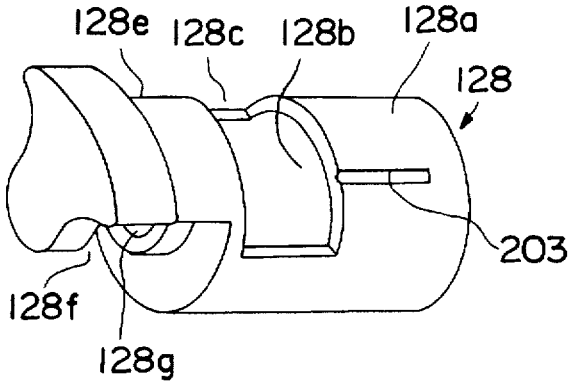
FIG. 10 is a perspective view of a piston in accordance with a fifth embodiment of the present invention.

FIG. 10 illustrates a fifth embodiment of the present invention which is similar to a first embodiment except for the following constructions. Piston 128 includes at least one linear groove 203 formed on the outer periphery surface of cylindrical body 128a. At least one groove 203 extends linearly from one side of aperture 128c, so that groove 203 is preferably parallel to the longitudinal axis of piston 128 for storing lubricating oil therein. Alternatively, at least one linear groove 203 may be perpendicular to the longitudinal axis of piston 128, e g., may be annularly formed with respect to cylindrical body 128a.

Figure 11:
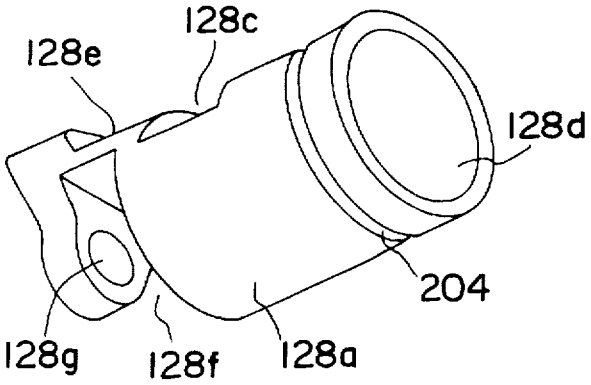
FIG. 11 is a perspective view of a piston in accordance with a sixth embodiment of the present invention.

FIG. 11 illustrates a sixth embodiment of the present invention which is similar to a first embodiment except for the following constructions. Piston 128 includes at least one annular groove 204 formed on the outer periphery surface of cylindrical body 128a. At least one annular groove 204 is formed around the periphery surface of cylindrical body 128a so as to be preferably perpendicular to the longitudinal axis of piston 128 for storing lubricating oil therein.

In such structures, substantially the same advantages as those in the first embodiment can be obtained. Further, toe foregoing constructions prevent piston 128 and cylinder bore 127 from wearing each other because opening 202 and grooves 203 and 204 may introduce or accumulate lubricating oil therein. As a result, the compressor has a superior durability since the construction prolongs life of piston 128 and cylinder bore 127.

Although the present invention has been described in detail with respect to the preferred embodiments, the invention is not limited thereto. Specifically, while the preferred embodiments illustrate the invention in a swash plate type compressor, this invention is not restricted to a swash plate type refrigerant compressor, but may be employed in other piston-type refrigerant compressors. It will be understood by those of ordinary skill in the art that variations and modifications may be made within the scope of this invention as defined by the appended claims. Accordingly, the embodiments and features disclosed herein are provided by way of example only. It is to be understood that the scope of the present invention is not to be limited thereby, but is to be determined by the claims which follows.

I claim:

1. A piston-type fluid displacement apparatus comprising:

a housing enclosing a crank chamber, a suction chamber, and a discharge chamber, said housing including a cylinder block, wherein a plurality of cylinder bores formed in said cylinder block;

a drive shaft rotatably supported in said cylinder block;

a plurality of pistons slidably disposed within said cylinder bores, each of said pistons including a cylindrical body and an engaging portion axially extending from a first axial end of said cylindrical body;

a plate having an angle of tilt and tiltably connected to said drive shaft;

a bearing coupling said plate to each of said pistons, so that said pistons reciprocates within said cylinder bores upon rotation of said plate, comprising:

said piston including a first aperture formed in a periphery surface of said cylindrical body; a second aperture formed in an interior of said cylindrical body, so that said second aperture communicates with said first aperture; and cover means secured to a second axial end of said cylindrical body for covering said second aperture.

2. The piston-type fluid displacement apparatus of claim 1, wherein said first aperture is formed with a rectangular shape along a curved periphery surface of said cylindrical body of said piston.

3. The piston-type fluid displacement apparatus of claim 1, wherein said second aperture is formed as a cylindrical shape extending from one axial end of said cylindrical body to said first aperture.

4. The piston-type fluid displacement apparatus of claim 1, wherein said cover means is a circular plate member.

5. The piston-type fluid displacement apparatus of claim 4, wherein said circular plate member has an outer diameter less than a diameter of said cylindrical body of said piston.

6. The piston-type fluid displacement apparatus of claim 1, wherein said piston includes at least one supporting portion is connected to opposite side edges of said first aperture for supporting said cylindrical body.

7. The piston-type fluid displacement apparatus of claim 1, wherein said piston includes at least one supporting portion is connected to opposite inner surfaces of said cylindrical body for supporting said cylindrical body.

8. The piston-type fluid displacement apparatus of claim 1, wherein said piston includes at least one groove formed on a periphery surface of said cylindrical body for storing lubricating oil.

9. The piston-type fluid displacement apparatus of claim 8, wherein said at least one groove is linear in shape.

10. The piston-type fluid displacement apparatus of claim 8, wherein said at least one groove is annular in shape.

11. The piston-type fluid displacement apparatus of claim 1, wherein said piston includes at least one opening formed on a periphery surface of said cylindrical body for introducing lubricating oil.

12. A swash plate-type refrigerant compressor comprising;

a compressor housing enclosing a crank chamber, a suction chamber, and a discharge chamber therein, said compressor housing including a cylinder block;

a plurality of cylinders formed in said cylinder block, each of said cylinders having an inner surface;

a plurality of pistons, each of which is slidably disposed within one of said cylinders, each of said pistons having a cylindrical body and an engaging portion axially extending from a first axial end of said cylindrical body;

a drive shaft ratably supported in said cylinder block a plate tiltably connected to said drive shaft;

a bearing coupling said plate to each of said pistons, so that said pistons reciprocate within said cylinders upon rotation of said plate;

at least one working chamber defined between an end of each of said pistons and an inner surface of each of said cylinders;

a support portion disposed coaxially with said drive shaft and tiltably supporting a central portion of said plate; comprising:

said piston including a first aperture formed in a periphery surface of said cylindrical body; a second aperture formed in an interior of said cylindrical body, so that said second aperture communicates with said first aperture; and cover means secured to a second axial end of said cylindrical body for covering said second aperture.

13. The swash plate-type refrigerant compressor of claim 12, wherein said first aperture is formed with a rectangular shape along a curved periphery surface of said cylindrical body of said piston.

14. The swash plate-type refrigerant compressor of claim 12, wherein said second aperture is formed as a cylindrical shape extending from one axial end of said cylindrical body to said first aperture.

15. The swash plate-type of refrigerant compressor of claim 12, wherein said cover means is a circular plate member.

16. The swash plate-type refrigerant compressor of claim 15, wherein said circular plate member has an outer diameter less than a diameter of said cylindrical body of said piston.

17. The swash plate-type refrigerant compressor of claim 12, wherein said piston includes at least one supporting portion is connected to opposite side edges of said first aperture for supporting said cylindrical body.

18. The swash plate-type refrigerant compressor of claim 12, wherein said piston includes at least one supporting portion is connected to opposite inner surfaces of said cylindrical body for supporting said cylindrical body.

19. The swash plate-type refrigerant compressor of claim 12, wherein said piston includes at least one groove formed on a periphery surface of said cylindrical body for storing lubricating oil.

20. The swash plate-type refrigerant compressor of claim 19, wherein said at least one groove is linear in shape.

21. The swash plate-type refrigerant compressor of claim 19, wherein said at least one groove is annular in shape.

22. The swash plate-type refrigerant compressor of claim 12, wherein said piston includes at least one opening formed on a periphery surface of said cylindrical body for introducing lubricating oil.

23. A piston-type fluid displacement apparatus comprising:

a housing enclosing a crank chamber, a suction chamber, and a discharge chamber, said housing including a block, wherein a plurality of bores formed in said block;

a drive shaft rotatably supported in said block;

a plurality of pistons slidably disposed within said bores, each of said pistons including a body and an engaging portion axially extending from a first axial end of said body;

a plate having an angle of tilt and tiltably connected to said drive shaft;

a bearing coupling said plate to each of said pistons, so that said pistons reciprocates within said bores upon rotation of said plate, comprising:

said piston including a first aperture formed in a periphery surface of said body;

a second aperture formed in an interior of said body, so that said second aperture communicates with said first aperture; and cover means secured to a second axial end of said body for covering said second aperture.

* * * * *